US006810529B1

(12) United States Patent
Reilly et al.

(10) Patent No.: US 6,810,529 B1
(45) Date of Patent: Nov. 2, 2004

(54) PROTECTIVE GARMENT WITH CARD DISPLAYING OR RECORDING DATA UNIQUE TO AUTHORIZED WEARER AND READABLE THROUGH GARMENT POCKET WINDOW

(75) Inventors: John J. Reilly, Bayside, NY (US); William L. Grilliot, Dayton, OH (US); Mary I. Grilliot, Dayton, OH (US)

(73) Assignee: Morning Pride Manufacturing, L.L.C.

( * ) Notice: Subject to any disclaimer, the term of this patent is extended or adjusted under 35 U.S.C. 154(b) by 0 days.

(21) Appl. No.: 10/607,952

(22) Filed: Jun. 27, 2003

(51) Int. Cl.[7] ..... A41D 27/20
(52) U.S. Cl. ..... 2/69; 2/247
(58) Field of Search ..... 2/247–253, 227, 2/79, 94, 108, 69, 46, 69.5, 81, 82, 102; 40/124.01, 299.01, 586

(56) References Cited

U.S. PATENT DOCUMENTS 3,829,995 A * 8/1974 Fakoury ..... 40/649
4,924,613 A * 5/1990 Levin ..... 40/586
5,195,123 A * 3/1993 Clement ..... 378/166
5,379,461 A * 1/1995 Wilmers ..... 2/115
5,548,847 A * 8/1996 Spicijaric ..... 2/209.13
5,572,741 A 11/1996 Bowman
5,596,652 A 1/1997 Piatek et al.
5,632,044 A * 5/1997 Sloot ..... 2/102
5,692,237 A * 12/1997 Bennett ..... 2/93
5,884,338 A * 3/1999 Golde ..... 2/247
6,029,889 A 2/2000 Whalen, Jr. et al.
6,643,967 B1 * 11/2003 Bloom ..... 40/789

* cited by examiner

*Primary Examiner*—Tejash Patel
(74) *Attorney, Agent, or Firm*—Wood, Phillips, Katz, Clark & Mortimer

(57) ABSTRACT

A protective garment, which is intended to be only worn by a wearer who is authorized to pass through a security perimeter, comprises a pocket, which defines a window, a flap, which is movable between a position wherein the flap covers the window and positions wherein the flap does not cover the window, and a card, which is disposed in the pocket. The card displays or records data, which are readable through the window by a human, by an electronic reader, or by both, and which are unique to the authorized wearer of the protective garment. The data may comprise symbolic data, such as bar code data, and may comprise a photograph of the authorized wearer of the protective garment. When the flap covers the window, the flap protects the data against becoming illegible because of foreign matter, such as soot, or because of surface abrasion.

8 Claims, 1 Drawing Sheet

PROTECTIVE GARMENT WITH CARD DISPLAYING OR RECORDING DATA UNIQUE TO AUTHORIZED WEARER AND READABLE THROUGH GARMENT POCKET WINDOW

TECHNICAL FIELD OF THE INVENTION

This invention pertains to a protective garment, which is intended to be worn by a wearer, such as a firefighter, an emergency worker, a police officer, or a military person, who is authorized to pass through a security perimeter. This invention contemplates that the protective garment comprises a card, which is disposed in a pocket defining a window and which displays or records data readable through the window and unique to the authorized wearer.

BACKGROUND OF THE INVENTION

Commonly, a firefighter carries an identifying card, which may display bar code data identifying the firefighter and which may display a photograph of the firefighter. As exemplified in U.S. Pat. Nos. 5,596,652 and 6,029,889, the disclosures of which are incorporated herein by reference, it is known for said data to be electronically scanned and to be then used to track firefighters arriving at a firefighting site, entering the firefighting site, and leaving the firefighting site.

As a matter of related interest, U.S. Pat. No. 5,572,741 discloses, on a firefighter's garment, a label bearing warnings, washing information, or other information. As stitched in place, the label is covered by a transparent, protective layer of a heat resistant, abrasion resistant, substantially waterproof material, which is stitched in place, all the way around the label. The material may be a biaxially oriented, copolymer film, such as KAPTON film manufactured by E.I. DuPont de Nemours and Company of Wilmington, Delaware.

Historically, perimeter security has been needed at military bases and other military sites. Terrorist activities on Sep. 11, 2001, in the United States and other incidents have highlighted that perimeter security may be also needed at firefighting sites and other sites, particularly where numerous firefighters, emergency workers, and police officers are gathered, many of whom may not be personally acquainted with one another.

SUMMARY OF THE INVENTION

This invention provides a protective garment, which is intended to be only worn by a wearer who is authorized to pass through a security perimeter. The protective garment comprises a pocket, which defines a window, and an external flap, which is movable between a position wherein the flap covers the window and positions wherein the flap does not cover the window. Preferably, the protective garment further comprises means, such as a hook-and-loop fastener, for attaching the flap detachably in the position wherein the flap covers the window.

The window becomes visible from outside the protective garment, when the flap has been moved to one of the positions wherein the flap does not cover the window, without further manipulation of the protective garment.

This invention contemplates that the protective garment further comprises a card, which is disposed in the pocket. The card displays or records data, which are readable through the window by a human, by an electronic reader, or by both, and which are unique to the authorized wearer of the protective garment. The data may comprise symbolic date, such as bar code data, which identifies the authorized wearer, and a photograph of the authorized wearer of the protective garment.

As read by an electronic reader, the data may be used for perimeter security, by being compared to a database of authorized wearers, via a computer receiving the data from the electronic reader. Additionally, the same data may be used for any similar or dissimilar purpose disclosed in U.S. Pat. No. 5,596,652 and No. 6,029,889, supra. When the flap covers the window, the flap protects the data against becoming unreadable because of foreign matter, such as soot, or because of surface abrasion.

BRIEF DESCRIPTION OF THE DRAWINGS

As illustrated in FIGS. 1 and 2, a flap of the protective garment is raised and a card is disposed in a pocket defining a window, through which data displayed by the card are visible.

DETAILED DESCRIPTION OF THE PREFERRED EMBODIMENT

Figure 1:
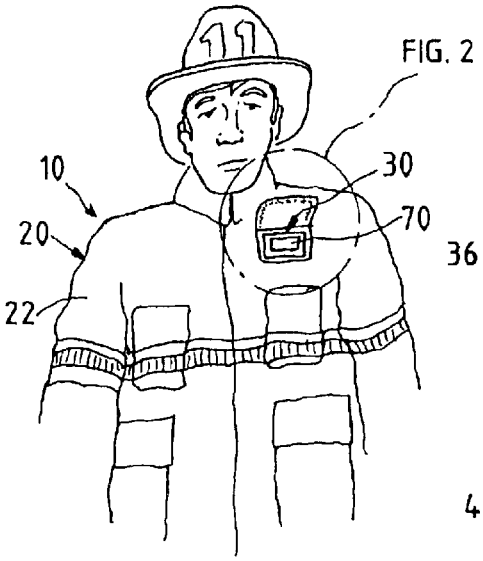
FIG. 1 is a front, fragmentary, perspective view of a firefighter wearing a protective garment embodying this invention.
Figure 2:
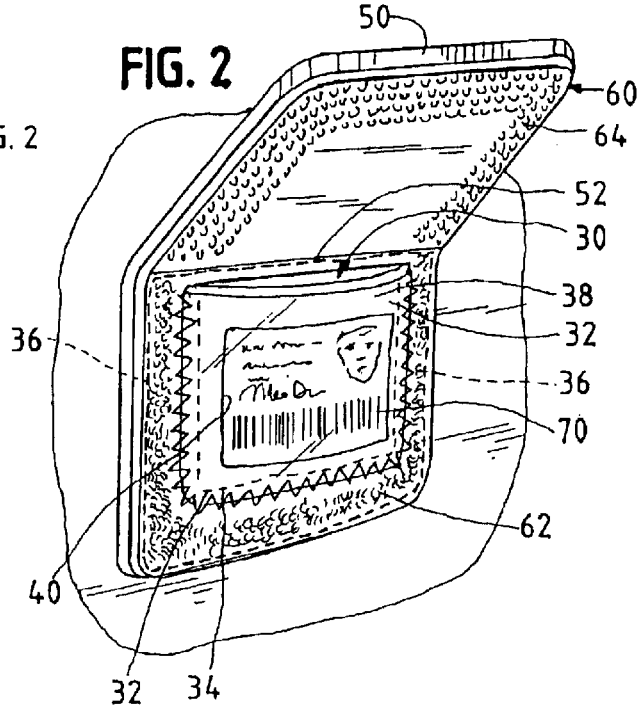
FIG. 2 is an enlarged detail taken from a region indicated in FIG. 1.
Figure 3:
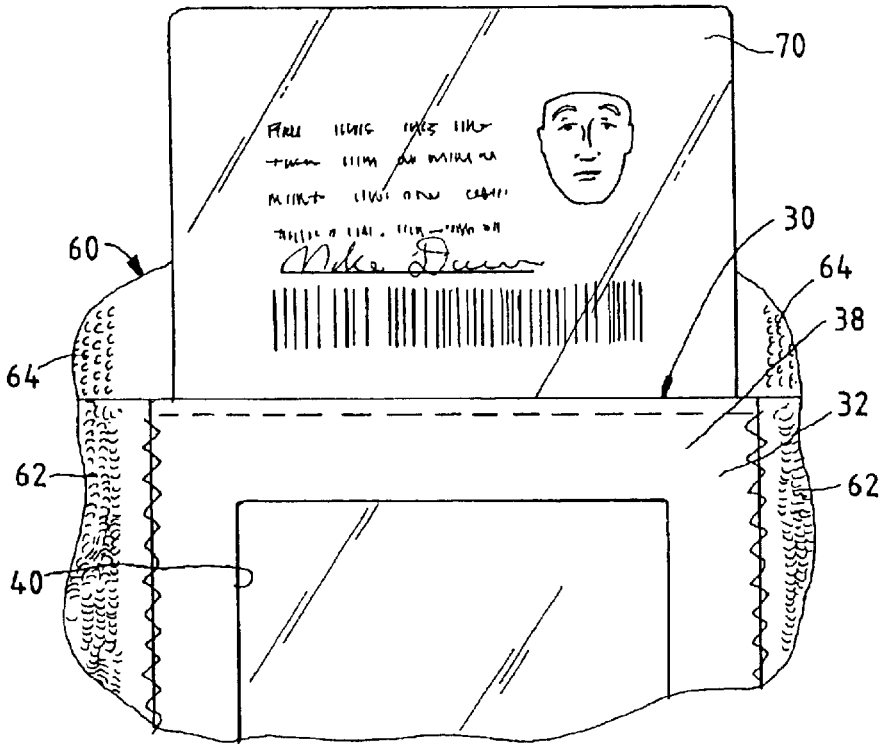
FIG. 3, on a larger scale, is a further enlarged detail taken from a slightly different vantage and illustrating the card as being inserted into or having been removed from the pocket.

As illustrated, a protective garment 10 for a firefighter comprises an outer shell 20, which has an outer layer 22, a generally rectangular pocket 30, which defines a generally rectangular window 40 and which is provided by a fabric panel 32 sewn to the outer layer 22 of the main body 20, along a bottom margin 34 of the fabric panel 32 and along two lateral margins 36 of the fabric panel 32 but not along a top margin 38 of the fabric panel 32, and an external, a generally rectangular flap 50, which is sewn to the outer layer 22 of the outer shell, along one edge 52 of the flap 50, above the top margin 30 of the fabric panel 32.

Preferably, as illustrated, the fabric panel 32 defining the pocket 30 is sewn on a chest portion of the outer layer of the outer shell 20. Alternatively, the fabric panel 32 defining the pocket 30 is sewn on another portion thereof, such as on an arm portion. The outer layer 22 of the outer shell 20 is made from any fabric used heretofore for outer layers of outer shells of protective garments for firefighters and the fabric panel 32 and the flap 50 are made from the same fabric or from another suitable material.

Because the fabric panel 32 is not sewn to the outer layer 22 of the outer shell 20 along the top margin 38, the top margin 38 of the fabric panel 32 remains detached from the outer layer 22 of the outer shell 20. The flap 50 is movable between a window-covering position wherein the flap 50 overlies the margins 32, 34, 26, 38, so as to cover the window 40, and other positions wherein the flap 50 does not cover the window 40. The flap 50 is illustrated in one of the positions wherein the flap 50 does not cover the window 40.

The window 40 becomes visible from outside the protective garment, when the flap 50 has been moved to one of the positions wherein the flap 50 does not cover the window 40, without further manipulation of the protective garment 30.

As illustrated, a hook-and-loop fastener 60 is provided for attaching the flap 50 detachably in the window-covering position. The hook-and-loop fastener 60 comprises loopfaced tapes 62, which are sewn to the fabric panel 32 along its margins 32, 34, and hook-faced tapes 64, which are sewn to the flap 60 along flap margins 52, 54, where the flap 50 overlies the margins 32, 34, when the flap 50 is in the window-covering position. Other detachable attaching means, such as a mechanical zipper or a series of snap fasteners, may be alternatively provided for attaching the flap 50 detachably in the window-covering position.

As illustrated, a card 70 displays, on its anterior surface, alphanumeric data, which includes the name, departmental rank, and departmental affiliation of an authorized wearer of the protective garment 10, symbolic data, such as bar code data, which identify the authorized wearer and which can be electronically read by an electronic reader, such as a bar code scanner if the card 70 displays bar code data, and a photograph of the authorized wearer. The card 70 is disposed in the pocket 30 so that the data displayed by the card 70, on its anterior surface, are visible through the window 40. Moreover, the card 70 may display other data, such as a medical history of the authorized wearer, on its posterior surface. Advantageously, the card 70 is removable from the pocket 30, as for laundering of the protective garment 10.

Along with or instead of the data described in the preceding paragraph, the card 70 may record, via a magnetic strip or a microchip or otherwise, data that identify the authorized wearer and that are readable via an electronic reader, such as an electronic scanner.

When the flap 50 covers the window 40, the flap 50 protects the data displayed on the anterior surface of the card 70 against becoming illegible because of foreign matter, such as soot, or because of surface abrasion. Optionally, for further protection thereagainst a separate, transparent, protective sheet is disposed in the pocket 30, so as to cover the anterior surface of the card 70. Optionally, for further protection thereagainst, the card 70 is made from cardboard but is laminated between two transparent, protective sheets.

As read by an electronic reader, the data displayed on the anterior surface of the card 70 may be used for perimeter security, by being compared to a database of authorized wearers, via a computer receiving the data from the electronic reader. Additionally, the same data may be used for any similar or dissimilar purpose disclosed in U.S. Pat. Nos. 5,596,652 and 6,029,889, supra.

What is claimed is:

1. A protective garment, which is intended to be only worn by a wearer who is authorized to pass through a security perimeter, the protective garment comprising a pocket, which defines a window, the protective garment further comprising an external flap, which is movable outside the protective garment, between a position wherein the flap covers the window and positions wherein the flap does not cover the window, which becomes visible from outside the protective garment, when the flap has been moved to one of the positions wherein the flap does not cover the window, without further manipulation of the protective garment, and the protective garment further comprising a card, which is disposed in the pocket, the card displaying data, which are readable through the window by a human, by an electronic scanner, or by both, and which are unique to the authorized wearer of the protective garment, whereby, when the flap covers the window, the flap protects the data against becoming illegible because of foreign matter, such as soot, or because of surface abrasion.

2. The protective garment of claim 1 further comprising means for attaching the flap detachably in the position wherein the flap covers the window.

3. The protective garment of claim 2, wherein the attaching means comprises a hook-and-loop fastener.

4. The protective garment of claim 1, 2, or 3, wherein said data comprise symbolic data identifying the authorized wearer of the protective garment.

5. The protective garment of claim 1, 2, or 3, wherein said data comprise bar code data identifying the authorized wearer of the protective garment.

6. The protective garment of claim 1, 2, or 3, wherein said data comprise a photograph of the authorized wearer of the protective garment.

7. The protective garment of claim 1, 2, or 3, wherein the pocket has a top margin, a bottom margin, and two lateral margins and wherein the pocket is sewn to an outer shell of the protective garment along three of said margins.

8. The protective garment of claim 7, wherein the pocket is sewn to the outer shell of the protective garment along the bottom and lateral margins but not along the top margin.

* * * * *